US006537389B1

(12) United States Patent
Aichele et al.

(10) Patent No.: US 6,537,389 B1
(45) Date of Patent: Mar. 25, 2003

(54) SOFT MAGNETIC, DEFORMABLE COMPOSITE MATERIAL AND PROCESS FOR PRODUCING THE SAME

(75) Inventors: Wilfried Aichele, Winnenden (DE); Hans-Peter Koch, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/284,368

(22) PCT Filed: Aug. 11, 1998

(86) PCT No.: PCT/DE98/02297

§ 371 (c)(1),
(2), (4) Date: Aug. 13, 1999

(87) PCT Pub. No.: WO99/09565

PCT Pub. Date: Feb. 25, 1999

(30) Foreign Application Priority Data

Aug. 14, 1997 (DE) ..... 197 35 271

(51) Int. Cl.[7] ..... H01F 1/24

(52) U.S. Cl. ..... 148/307; 148/122; 148/240; 148/279; 419/35

(58) Field of Search ..... 419/35; 148/307, 148/122, 240, 279

(56) References Cited

U.S. PATENT DOCUMENTS 4,601,765 A * 7/1986 Soileau et al. ..... 148/104
5,183,631 A * 2/1993 Kugimiya et al. ..... 419/10
5,206,327 A * 4/1993 Matsumoto et al. ..... 528/4
5,211,896 A * 5/1993 Ward et al. ..... 264/126
5,348,800 A * 9/1994 Moro et al. ..... 428/328
5,798,439 A * 8/1998 Lefebvre et al. ..... 528/489
5,898,253 A * 4/1999 El-Antably et al. ..... 310/261
5,980,603 A * 11/1999 Thomas et al. ..... 75/252
6,410,770 B2 6/2002 Arkles et al.

FOREIGN PATENT DOCUMENTS

WO WO 92 20522 11/1992

OTHER PUBLICATIONS

ASM Handbook, vol. 7, Powder Metallurgy, p. 643–644, 1984.*

* cited by examiner

*Primary Examiner*—Daniel J. Jenkins
(74) *Attorney, Agent, or Firm*—Kenyon & Kenyon

(57) ABSTRACT

A magnetically soft, moldable composite material include powder grains coated with nonmagnetic thermoplastic compounds or with molecular precursors for ceramics or with intermetallic compounds, the magnetic properties of the magnetically soft composite material being adjustable in that fashion. Also described is a method for manufacturing a magnetically soft, shapable composite material coated in that fashion, which can subsequently be processed into shaped parts.

21 Claims, No Drawings

SOFT MAGNETIC, DEFORMABLE COMPOSITE MATERIAL AND PROCESS FOR PRODUCING THE SAME

FIELD OF THE INVENTION

The present invention relates to a magnetically soft, moldable composite material which contains powders that have magnetically soft properties and that have a nonmagnetic coating, and a method for its manufacture.

BACKGROUND INFORMATION

Magnetically soft materials are used for the manufacture of temperature-, corrosion-, and solvent-resistant magnetic components in the electronics sector, and in particular in electromechanics. These magnetically soft components generally have certain properties: high permeability ($\mu_{max}$), high magnetic saturation ($B_s$), low coercivity field strength ($H_c$), and high specific electrical resistance ($\rho_{spec}$). The combination of these magnetic properties with a high specific electrical resistance yields high switching dynamics; in other words, magnetic saturation and demagnetization of a component of this kind occur within a brief time period.

At present, soft iron plates, for example, are adhesively bonded into plate packets in order to serve as armatures of electric motors. Insulation of the plies is effective, however, in only one direction. European Patent No. 0 540 504 describes processing magnetically soft powders with a plastic binder and thereby manufacturing corresponding components using an injection-molding process. In order to guarantee the free-flowing capability necessary for injection molding, the powder components in injection-moldable composite materials are limited to a maximum of 65 vol %. On the other hand, densification of pourable powders under axial pressing, for example, is accomplished almost without material flow. The filling ratio of these composite materials is typically 90–98 vol %. The components shaped by axial pressing of powders are therefore characterized, in comparison to injection-molded ones, by considerably higher permeabilities and higher magnetic field strengths in the saturation range. Axial pressing of powders made of pure iron or nickel-iron with thermosetting resins, for example, epoxies or phenol resins, has the disadvantage, however, that the thermoplastic and thermosetting binders used hitherto are soluble or exhibit severe swelling at elevated temperature in organic solvents, for example, fuels for internal combustion engines. Under these conditions the corresponding composite components change dimensions, lose their strength, and fail completely. It was hitherto not possible to manufacture corresponding composite materials having good temperature and media resistance, for example, in organic solvents, in particular, in fuels for internal combustion engines. A further problem has hitherto been those utilization conditions for such components under which both thermoplastics and thermosetting resins no longer represent a suitable binder, since they would be completely decomposed.

The article by H. P. Baldus and M. Jansen in Angewandte Chemie, 1997, 109, pp. 338–394 describes modern high-performance ceramics which are formed from molecular precursors by pyrolysis, and in some cases also have magnetic properties. These ceramics are extremely stable with respect to temperature and solvents.

SUMMARY OF THE INVENTION

By coating magnetically soft powder grains with a nonmagnetic thermoplastic compound it is possible, advantageously, to increase the proportion of the magnetically soft powder in the composite material and, by the use of stable thermoplastic compounds, to achieve good temperature and solvent resistance for the shaped parts manufactured therefrom.

It is also particularly advantageous to coat a powder having magnetically soft properties with a silicon-containing compound which converts to a silicon-containing ceramic upon pyrolysis, thereby enhancing the coercivity field strength and decisively enhancing the temperature stability of a shaped part manufactured from that composite material.

Coating the magnetically soft powder with compounds of boron or of aluminum which convert upon pyrolysis into corresponding ceramics is a further preferred possibility for enhancing the solvent resistance and temperature resistance of the magnetically soft composite material and the shaped parts manufactured therefrom.

In an advantageous method for manufacturing a magnetically soft composite material, a thermoplastic compound is applied from a solution onto the powder grains. The powder grains are introduced into the polymer solution, and while the powder is in constant motion, the solvent is extracted at elevated temperature or under vacuum. The powder grains thereby receive a thin polymer coating in simple fashion, thus eliminating complex processes.

In the case of a coating with a material made from a precursor ceramic which contains either silicon, aluminum, or boron as principal components, after shaping of the material the temperature is advantageously selected so that the coating material converts into a ceramic, metallic, or even intermetallic end product, high magnetization and resistance to temperature and solvents being achieved.

In especially preferred fashion, the coating materials used are silicon compounds selected from the group consisting of binary hydrogen compounds of silicon, polydialkyl silanes, carbosilanes, polysilazanes, alkoxyalkyl silanes, alkyl polysiloxanes, alkyl silanols, and compounds of alkyl silanols with elements of the first main group. This ensures that a large class of molecular precursor compounds of silicon can be used, which upon pyrolysis make available various ceramics based on silicon-oxygen and also on silicon-nitrogen or silicon-nitrogen-oxygen, and can be optimized for the desired requirement profile. The corresponding ceramic, which also has an influence on the magnetic field strength and the switching time of the magnetically soft compounds, can be selected according to the applications of the component to be manufactured. It is also thereby possible to select the temperature range in accordance with the application.

In an equally preferred manner, boron compounds selected from the group consisting of borazol, pyridine or other π-donor boron adducts, for example borane-phosphane, borane-phosphinite, borane-sulfur, or boron-nitrogen adducts, boron silazanes, and polyborazanes, can be used to coat the magnetically soft powder, so that a variety of boron-containing ceramics can easily be made available after thermolysis.

It is also possible, in preferred fashion, to use as the aluminum precursor compound a polyalazane which can be used in very small quantities of 0.2 to 2 wt % in terms of the total portion weight. Aluminum-nitrogen ceramics are thereby produced as a coating for the magnetically soft powder, the proportion by weight of the magnetically soft powder being particularly high.

DETAILED DESCRIPTION

The following abbreviations will be used hereinafter:

PPA: Polyphthalamide

NMP: N-Methylpyrrolidone

1. Fuel-resistant thermoplastics with good high-temperature dimensional stability Thermoplastics with good high-temperature dimensional stability exhibit substantially less cold flow as compared to low-melting-point thermoplastics. When a mixture made up of magnet powder with small proportions of thermoplastic powders is pressed, a sufficient insulation layer around the magnetic particles is created only with ductile thermoplastic powders. In addition, high-melting-point thermoplastics are not available commercially as powders with the requisite small grain size of less than 5 micrometers. Both difficulties are circumvented by the invention, by the fact that the magnet powder is enveloped in a polymer solution prior to axial pressing. If solubility of the polymer exists only at higher temperatures, dissolution of the polymer and coating of the magnet powder must take place under inert gas in order to prevent thermo-oxidative damage to the thermoplastic material.

EXEMPLARY EMBODIMENT 1

17.5 g of a commercially available pelletized unreinforced PPA (Amodel 1000 GR of Amoco) is coarsely ground and dry-mixed in a Sigma kneader with 2500 g ARM 100.32 (surface-phosphatized pure iron powder of Höganäs). After the addition of NMP, nitrogen is fed through the kneading chamber until the oxygen has been displaced. The nitrogen stream is then shut off, and the chamber is heated to 200° C. (boiling point of NMP=204° C.). After a kneading period of approximately 1 hour, which depends on the volume of the thermoplastic material, the PPA has completely dissolved in NMP. Inert gas is once again passed through the kneading chamber to draw off the solvent, which is condensed in a cooler; the kneader is cooled, and the PPA-coated magnet powder is removed. Final solvent residues can be removed by vacuum drying.

Cold pressing of the coated magnet powder is followed by heat treatment of the compact under inert gas at a temperature above the melting point of the polymer (320° C., PPA). The resulting specimens have a strength of approximately 80 $N/mm^2$ and a specific electrical resistance of at least 400 $\mu$Ohm. Better unmolding of the pressed components from the shaping press is achieved by treating the surface of the coated powder with a lubricant. The lubricant is added in a considerably smaller proportion than the thermoplastic coating in order to reduce the density of the pressed parts as little as possible, and it should be sufficiently volatile that it volatilizes upon subsequent heat treatment before the polymer melts, and does not react chemically with the polymer. Examples of suitable lubricants are, for example, punching oils as used for punching sheet metals, or rapeseed oil methyl ester and stearic acid amide, at added quantities of approximately 0.2% in terms of the weight of the magnet powder.

2. Pressing dry mixtures of magnet powder and inorganic powders

The inorganic compounds or silicon-, boron-, and aluminum-organic compounds with a predominantly polymeric nature that are used for coating the magnetically soft powders have good slip properties and lubricating characteristics. After curing, they thus constitute a thermoplastic binder which is transformed, by subsequent thermal decomposition (pyrolysis), into a ceramic or into alloying additives for ferrous metals. In conjunction with oxidation-sensitive magnetic materials such as pure iron or pure nickel, pyrolysis is accomplished under inert gas. In order to obtain composite bodies with a low pore concentration, the volumetric contraction occurring during pyrolysis must be low; this is ensured by way of the compounds that are used. Silicon-hydrogen compounds (silicon hydrides) constitute one example. Silicon hydrides with multiple Si atoms are meltable, and thus serve simultaneously as lubricants for the coated magnetic powders. Depending on the hydride used, they decompose at higher temperatures into Si and $H_2$. As the temperature is raised further, the Si alloys into a surface layer, for example with pure iron powder. The Fe-Si alloy layer has a higher electrical resistance and a lower melting point than pure iron. The iron powder particles, coated with Fe-Si, sinter to form composite bodies having a higher electrical resistance as compared with pure iron. One alternative to this is to deposit ultrapure silicon onto iron powder particles by thermal decomposition of $SiH_4$. The method is usual in semiconductor fabrication in order to build up silicon layers and in the tempering of glasses. Low-molecular-weight silicon hydrides are pyrophoric, so that all process steps are performed under inert gas.

A silicon carbide ceramic according to the present invention is manufactured, for example, by pyrolysis of polydialkyl silanes. In combination with powders from the ferrous metal series, the release of carbon-containing compounds during pyrolysis results in carburization. The carbon fraction is then removed from the metal via annealing treatments in a hydrogen-containing atmosphere.

Precursor compounds for BN ceramics as the coating material are pyrolyzed in an ammonia atmosphere (R.C.P. Cubbon, RAPRA Review Report no. 76, Polymeric Precursors for Ceramic Materials, Vol. 7, No. 4, 1994). Borazol ($B_3,N_3,H_6$), which releases $H_2$ at only 90° C. under reduced pressure and converts to a polymer analogous to polyphenylene, has proven particularly suitable for magnetically soft composite materials with a ceramic coating. The release of $H_2$ continues at higher temperatures until, at about 750° C., the region of the hexagonal modification of BN is reached. In this particular case, pyrolysis is performed only under inert gas, for example argon or nitrogen, and not in an ammonia atmosphere. The minor weight loss (5.1%) which occurs in this connection results in little shrinkage and thus in a low pore volume in the composite made up of BN and the magnet powder.

The polyalazanes have proven to be suitable starting materials for coating magnet powders with an aluminum nitride ceramic. They have been synthesized by thermal condensation of diisobutylaluminum hydride with unsaturated nitrites, yielding curable liquid polyalazanes. The magnet powders were coated with these. The polyalazanes served simultaneously as thermosetting lubricants and binders which then, after pyrolysis at 200° C., crosslink to form a nonmelting solid, and in the next process step are completely pyrolyzed in an inert atmosphere to form AlN.

Carbosilanes and polysilazanes have proven to be suitable starting materials for coating magnet powders with a silicon nitride ceramic. Silicon nitride ($Si_3N_4$) is produced by pyrolysis of these compounds in an ammonia atmosphere. Pyrolysis under inert gas yielded a coating with silicon carbonitrides having the formula $SiN_xC_y$.

Glasses, enamels, and glazes represent combinations of metal oxides and nonmetal oxides of various compositions. One exemplary embodiment for the manufacture of glass-like coatings of magnetically soft powders is the use of silanes having multiple silanol groups, which respond to the addition of water by releasing alcohol and forming polymers. The product NH 1200 manufactured by Hüls is an incompletely crosslinked, soluble, and meltable polycondensate of trimethoxymethyl silane $(CH_3Si(OCH_3)_3)_x$, and constitutes an outstanding precursor material for a glass-like coating for magnetic powders. NH 1200 can be further condensed with the release of water and alcohol, and upon subsequent pyrolysis converts, with a ceramic yield of approximately 90 wt %, into a glass having the composition $SiO_xC_y$ (x=1.9–2.1, y=0.6–3.0).

EXEMPLARY EMBODIMENT 2

99.9 wt % ABM 100.32 soft iron powder (surface-phosphatized, Hoeganaes) is coated with 0.6 wt % NH 2100; this is done in a solution in acetone. This mixture is pressed into bar specimens at room temperature under a pressure of 6 mt/cm$^2$, and the resin crosslinks at 220° C. The resulting specimen has a strength of 26 N/mm$^2$ and a specific electrical resistance of 20,000 $\mu$Ohm. The polymer is then pyrolyzed at 700° C. under inert gas, and converts into a carbon-containing glass $SiO_xC_y$. Initial sintering bridges also form between the iron particles. This decreases the electrical resistance to 5 $\mu$Ohm (the value for pure iron is 0.1 $\mu$Ohm), while bending strength increases to 80 N/mm$_2$. As the temperature is increased further, the iron-iron sintering bridges and the strength increase, while the specific electrical resistance decreases further.

The addition of further compounds which can be converted into glass-forming oxides yields the corresponding glasses or enamels. Their composition is selected with a view to good adhesion to the magnet powder. For example, the addition of aluminum stearate serves both as a lubricant for unmolding from the pressing tool and, after its thermal decomposition to $Al_2O_3$, as a glass former.

EXEMPLARY EMBODIMENT 3

946.5 g phosphatized iron powder (AB 100.32, Hoeganaes) is wetted in a kneader with a solution of 2.4 g methylpolysiloxane prepolymer (NH 2100, Chemiewerk Nunchritz) in acetone. The addition of a solution of 46.3 g sodium trimethyl silanolate in acetone causes formation of a gel coating around the iron particles. After evaporation of the acetone in the kneader, 5 g aluminum tristearate is added, and is melted while kneading at 140° C. The aluminum tristearate acts as a lubricant and mold release agent during subsequent axial pressing of the composite material. Heating the compacts under inert gas to 200° C. first causes the methylpolysiloxane prepolymer to cure. As the temperature is raised further to 800° C., all the products involved pyrolyze, then melt to yield approximately 40 g of a glass having the approximate composition of 27 g $SiO_2$, 12.8 g $Na_2O$, and 0.3 g $Al_2O_3$.

What is claimed is:

1. A magnetically soft, moldable composite material, comprising:

at least one aluminum-containing compound; and a powder including grains, the powder having magnetically soft properties, the grains of the powder being coated with the at least one aluminum-containing compound, wherein the at least one aluminum-containing compound includes a polyalazane.

2. The composite material as defined in claim 1, wherein a proportion of the polyalazane is 0.2 to 2 wt % in terms of a total portion weight.

3. A magnetically soft, moldable composite material, comprising:

at least one silicon-containing compound; and a powder including grains, the powder having magnetically soft properties, the grains of the powder being coated with the at least one silicon-containing compound, wherein the at least one silicon-containing compound is selected from the group consisting of polydialkyl silanes, carbosilanes, polysilazanes, alkoxyalkyl silanes, alkyl polysiloxanes, alkyl silanols and compounds of alkyl silanols with at least one element of the group.

4. The composite material as defined in claim 3, wherein a proportion of the at least one silicon-containing compound is 0.2 to 6 wt % in terms of a total portion weight.

5. The composite material as defined in claim 3, wherein a proportion of the at least one silicon-containing compound is 0.3 to 1 wt % in terms of a total portion weight.

6. A magnetically soft, moldable composite material, comprising:

at least one silicon-containing compound; and a powder including grains, the powder having magnetically soft properties, the grains of the powder being coated with the at least one silicon-containing compound;

wherein the at least one silicon-containing compound includes at least two silicon-containing compounds selected from the group consisting of hydrogen compounds of silicon, chlorine compounds of silicon, silicon-containing carbodiimides, polydialkyl silanes, carbosilanes, polysilazanes, silazanes, alkoxyalkyl silanes, alkyl polysiloxanes, alkyl silanos, and compounds of alkyl silanols with at least one element of the group.

7. The composite material as defined in claim 6, wherein a proportion of the at least two silicon-containing compounds is 0.2 to 6 wt % in terms of a total portion weight.

8. The composite material as defined in claim 6, wherein a proportion of the at least two silicon-containing compounds is 0.3 to 5 wt % in terms of a total portion weight.

9. The composite material as defined in claim 7, wherein a weight ratio of the two silicon-containing compounds to one another is 1:10 to 1:25.

10. The composite material as defined in claim 8, wherein a weight ratio of the two silicon-containing compounds to one another is 1:10 to 1:25.

11. The composite material as defined in claim 7, wherein a weight ratio of the two silicon-containing compounds to one another is 1:15 to 1:21.

12. The composite material as defined in claim 8, wherein a weight ratio of the two silicon-containing compounds to one another is 1:15 to 1:21.

13. A magnetically soft, moldable composite material, comprising:

at least one silicon-containing compound;

a powder including grains, the powder having magnetically soft properties, the grains of the powder being coated with the at least one silicon-containing compound; and an organic aluminum compound coating the grains of the powder.

14. The composite material as defined in claim 13, wherein a proportion of the at least one of (A) and (B) is 0.2 to 2 wt %.

15. The composite material as defined in claim 13, wherein a proportion of the at least one of (A) and (B) is 0.2 to 0.9 wt %.

16. A magnetically soft, moldable composite material, comprising:

at least one boron-containing compound; and a powder including grains, the powder having magnetically soft properties, the grains of the powder being coated with the at least one boron-containing compound;

wherein the at least one boron-containing compound is selected from the group consisting of borazol, n-donor boron adduct, borasilazane, and polyborasilazanes.

17. A method for manufacturing a magnetically soft, moldable composite material, comprising the steps of:

coating grains of a powder with at least one silicon-containing compound, the powder having magnetically soft properties;

mold pressing the powder; and heat treating the mold-pressed powder;

wherein the step of heat treating includes the step of selecting a temperature such that a material of the coating converts into at least one of a metallic end product and an intermetallic end product.

18. The method as defined in claim 17, further comprising the steps of:

coating the grains of the powder with at least one of (A) an organometallic aluminum compound and (B) an organic aluminum compound; and preliminary heat treating prior to the step of heat treating the mold-pressed powder.

19. The method as defined in claim 18, wherein the step of preliminary heat treating includes the step of raising a temperature to between 100° C. and 200° C.

20. The method as defined in claim 18, wherein the step of preliminary heat treating includes the step of raising a temperature to between 120° C. and 180° C.

21. The composite material as defined in claim 16, wherein a proportion of the at least one boron-containing compound is 0.2 to 2 wt % in terms of a total portion weight.

* * * * *

UNITED STATES PATENT AND TRADEMARK OFFICE

CERTIFICATE OF CORRECTION

PATENT NO. : 6,537,389 B1
DATED : March 25, 2003
INVENTOR(S) : Aichele et al.

It is certified that error appears in the above-identified patent and that said Letters Patent is hereby corrected as shown below:

Column 6,
Line 59, change "silanos" to -- silanols --

Signed and Sealed this

Ninth Day of December, 2003

JAMES E. ROGAN
*Director of the United States Patent and Trademark Office*